US006581686B2

(12) United States Patent
Armatage

(10) Patent No.: US 6,581,686 B2
(45) Date of Patent: Jun. 24, 2003

(54) METHOD OF AND DEVICE FOR TRACING HYDRAULIC FRACTURES, STIMULATIONS, CEMENT JOBS, ETC. IN OIL AND GAS WELLS

(75) Inventor: Russell J. Armatage, Brooks (CA)

(73) Assignee: Digital Tracing Systems Ltd, Brooks (CA)

( * ) Notice: Subject to any disclaimer, the term of this patent is extended or adjusted under 35 U.S.C. 154(b) by 0 days.

(21) Appl. No.: 09/972,251

(22) Filed: Oct. 9, 2001

(65) Prior Publication Data

US 2003/0066645 A1 Apr. 10, 2003

(51) Int. Cl.[7] ..... E21B 47/09; E21B 47/00

(52) U.S. Cl. ..... 166/252.6; 166/250.12; 166/66; 166/253.1; 166/254.2; 73/152.39

(58) Field of Search ..... 166/254.1, 254.2, 166/252.6, 250.12, 66, 253.1; 73/152.39

(56) References Cited

U.S. PATENT DOCUMENTS 4,524,434 A * 6/1985 Silverman ..... 367/37
5,010,527 A * 4/1991 Mahrer ..... 367/86
5,151,658 A * 9/1992 Muramatsu et al. ..... 324/346
6,125,934 A * 10/2000 Lenn et al. ..... 166/250.12
6,333,700 B1 * 12/2001 Thomeer et al. ..... 340/854.8
6,464,021 B1 * 10/2002 Edwards ..... 175/61

* cited by examiner

*Primary Examiner*—Hoang Dang
(74) *Attorney, Agent, or Firm*—I. Zborovsky

(57) ABSTRACT

Tracing hydraulic fractures, stimulations, selective cement jobs, etc. in oil and gas wells includes introducing into a well in a zone of interest a plurality of radio frequency transmitting elements each having an identification, moving in the well a reader tool operative for transmitting radio waves so as to generate and send a radio frequency signal for activating the radio frequency transmitting elements and thereafter to receive a signal returned from the corresponding radio frequency transmitting elements together with the identification of each radio frequency transmitting element, and analyzing data related to the sending of the radio frequency signal from the reader tool to the radio frequency transmitting element and the receiving of the radio frequency signal from the radio frequency transmitting elements with the identification of the radio frequency transmitting elements, so as to trace a corresponding hydraulic fracture, stimulation, selective cement job, etc., in the zone of interest.

20 Claims, 1 Drawing Sheet

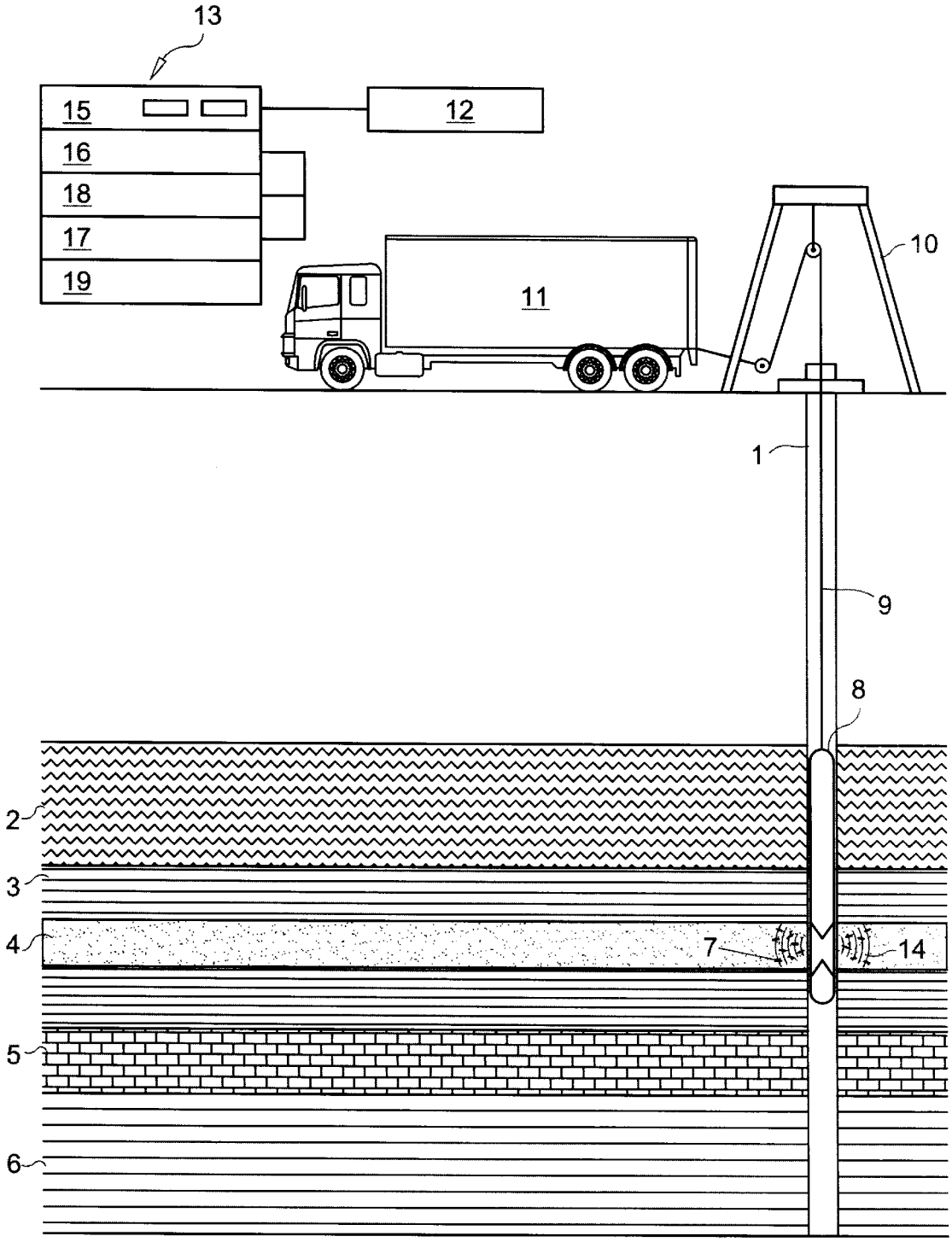
13
15
16
18
17
19
12
11
10
1
9
8
2
3
4
7
14
5
6

METHOD OF AND DEVICE FOR TRACING HYDRAULIC FRACTURES, STIMULATIONS, CEMENT JOBS, ETC. IN OIL AND GAS WELLS

BACKGROUND OF THE INVENTION

The present invention relates to a method of and device for tracing hydraulic fractures, stimulations, cement jobs, etc. in oil and gas wells.

Methods of and devices for tracing hydraulic fractures, stimulations, cement jobs, etc. are known. One of such methods includes injection of radioactive materials into the slurry and later logging with a gamma ray tool. This method has the disadvantage that it can be harmful to personnel and the environment. Some of the known methods are disclosed for example in U.S. Pat. Nos. 4,926,940; 5,044,436; 5,151,658; 5,723,781; 6,003,365. It is believed that the existing methods and devices of this type can be improved.

SUMMARY OF THE INVENTION

Accordingly, it is an object of the present invention to provide a method of and a device for tracing hydraulic fractures, stimulations, cement jobs, etc. in oil and gas wells, which avoid the disadvantages of the prior art.

More particularly, it is an object of the present invention to provide a method of and device for tracing hydraulic fractures, stimulations, cement jobs, etc. in oil and gas wells, which does not use radioactive materials for tracing the above mentioned structures and therefore is not harmful to personnel and the environment.

In keeping with these objects and with others which will become apparent hereinafter, one feature of the present invention resides, briefly stated, in a method of tracing hydraulic fractures, stimulations, selective cement jobs, etc. in oil and gas wells, which includes the steps of introducing into a well in a zone of interest a plurality of radio frequency transmitting elements each having an identification, moving in the well a reader tool operative for transmitting radio waves so as to generate and send a radio frequency signal for activating the radio frequency transmitting element and thereafter to receive a radio frequency signal returned from the corresponding radio frequency transmitting elements together with the identification of each radio frequency transmitting element, and analyzing data related to the sending of the radio frequency signal from the reader tool to the radio frequency transmitting element, and the receiving of the radio frequency signal from the radio frequency transmitting elements with the identification of the radio frequency transmitting elements so as to trace a corresponding hydraulic fracture, stimulation, selective cement job, etc., in the zone of interest.

Another feature of the present invention is a device for tracing hydraulic fractures, stimulations, selective cement jobs, etc. in oil and gas wells, comprising a plurality of radio frequency transmitting elements introducable into a well in a zone of interest and each having an identification; a reader tool movable in the well and operative for transmitting radio waves so as to generate and send a radio frequency signal for activating the radio frequency transmitting elements and thereafter to receive a radio frequency signal returned from the corresponding radio frequency transmitting elements together with the identification of each radio frequency transmitting element; and means for analyzing data related to the sending of the radio frequency signal from the reader tool to the radio frequency transmitting element, and the receiving of the radio frequency signal from the radio frequency transmitting elements with the identification of the radio frequency transmitting elements, so as to trace a corresponding hydraulic fracture, stimulation, selective cement job, etc., in the zone of interest.

When the method is performed and the device is designed in accordance with the present invention, tracing of hydraulic fractures, stimulations, selective cement jobs, etc. can be performed without the use of radioactive materials, and therefore without any harm to personnel and to the environment.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically illustrating a method of and device for tracing hydraulic fractures, stimulations, cement jobs, etc. in oil and gas wells in accordance with the present invention.

DESCRIPTION OF THE PREFERRED EMBODIMENTS

A method of tracing oil and gas well hydraulic fractures, stimulations, selective cement jobs, etc. and the device for implementing the method are used, as shown in the drawing, for example in a well with a borehole 1 which is drilled in the subsurface of the earth penetrating formations 2, 3, 4, 5, 6. The borehole 1 may or may not have fluid in it, although the inventive method and device may operate better when the borehole 1 has fluids.

In accordance with the present invention, a plurality of radio frequency transmitting elements, for example radio frequency identification chips or tags 7 are introduced into the borehole 1 in a zone of interest. The radio frequency elements 7 can be formed for example as the IDIO3 elements manufactured by Trovan, London, Great Britain. The radio frequency transmitting elements 7 are first read with a hand-held reader, for example such as the Trovan GR100 grip computer or the Trovan LID 570 pocket reader to give the time and date of introduction of the radio frequency transmitters into the hydraulic fracture, stimulation, selective cement job, etc. slurry, that will later be correlated with the surface recorded data. The radio frequency transmitting elements 7 are then sprinkled into the fracture medium stimulation chemicals or selective cement slurry at a predetermined rate and pumped down the well and into the formation using a corresponding known equipment. The number of radio frequency transmitting elements and which stages of the fracture, stimulation, or cement job to be traced is determined by a user.

A reader tool 8 is then conveyed into the borehole. For example, it can be lowered on an armored electrical cable, commonly called a Wireline 9 supported by a derrick 10 or another device and may be spooled onto a drum on a truck 11. By suitable rotation of the drum, the borehole reader tool may be lowered to any desired depth in the borehole. In the drawing for illustrative purposes the reader tool 8 is shown as being at the depth of the formation 4. This is commonly known as the perforated interval (zone of interest).

A surface power source 12 and a surface control unit 13 provide correspondingly electrical power and control signals through the electrical conductors in the Wireline 9 to the reader tool 8. In FIG. 1 the reader tool is shown as generating radio waves 14 into one of the subsurface formations and reaching the radio frequency transmitting elements 7. The radio frequency transmitting elements are then activated by the radio waves and reply to the reader tool 8 with a number which is unique for each radio frequency transmitting element.

The control unit 13 includes a power control unit 15 that controls the supply of power to the reader tool 8. The control unit 13 also includes a transmission control unit 16 that is used to initiate generation of the radio waves 14. Another component of the control unit 13 is a rotation control 17 that is used to control the orientation of the components of the reader tool 8. Still another component of the control unit 13 is the surface computer 18 complete with data acquisition and signal conditioning software and a printer/plotter 19 which is used to give the user a hard copy of the location of the radio frequency transmitting elements 7.

When the reader tool 8 is designed for operation at multiple levels in the borehole 1, the tool is lowered into the borehole 1 down past the zone of interest and raised in increments up the well. At each increment it remains long enough to emit the radio waves over 360° azimuth. For example it is possible to cover 12° per each increment. It thereby sends a radio frequency signal which activates the radio frequency transmitting elements 7, the radio frequency transmitting elements 7 then send a radio frequency signal together with its identification back to the reader tool 8. Then the reader tool 8 is raised again to the next depth increment, again emitting radio waves in a full 360°. This process will continue until the zone or zones of interest are passed fully. Depth increments are determined by the angle/reach of each emission of the radio waves.

The reader tool 8 measures the time from its radio frequency signal generation to the radio frequency signal return from the radio frequency transmitting elements 7 (travel time). This data is then sent to the surface computer which in turn will calculate the distance of the radio frequency transmitting elements from the reader tool 8. Another method of calling distance could be in measuring signal return strength. Then the data acquisition software conditions the received data and plots/prints the data onto a hard copy of a log correlated to the reader tool position in the borehole 1. Their unique number may represent each individual radio frequency transmitting element on the hard copy log.

The reader tool 8 can be a standard reader such as the Trovan model LID604 standard stationary decoder, in conjunction with an antenna for example Trovan ANT 611 sensor antenna. There are also available OEM reader boards that may be used to manufacture the reader tool. It is to be understood that other equipment can be used as well.

The reader tool may be also a static unit. In this case the reader tool can be lowered into the well with a slickline (non electric) Wireline unit or on a tubing, or another appropriate element. The reader tool will have a data storage unit integrated into the tool, as well as a power source. The tool is then returned to the surface after the appropriate intervals were covered, and the data will be downloaded from the tool into the computer on the surface.

For purposes of depth control, a magnetic casing collar locator or other suitable device for depth control can be incorporated in the reader. The borehole in the drawing is shown as a cased well. However, it is to be understood that the method and device of the present invention can be used in non-cased wells as well.

The results of the data analysis on the surface can be also represented three dimensionally or by animation.

It will be understood that each of the elements described above, or two or more together, may also find a useful application in other types of methods and constructions differing from the types described above.

While the invention has been illustrated and described as embodied in a method of and device for tracing hydraulic fractures, stimulations, cement jobs, etc. in oil and gas wells, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of tracing hydraulic fractures, stimulations, or selective cement jobs, in oil and gas wells, comprising the steps of introducing into a well in a zone of interest a plurality of radio frequency transmitting elements each having an identification, moving in the well a reader tool operative for transmitting radio waves so as to generate and send a radio frequency signal for activating the radio frequency transmitting elements and thereafter to receive a signal returned from the corresponding radio frequency transmitting elements together with the identification of each radio frequency transmitting element; and analyzing data related to the sending of the radio frequency signal from the reader tool to the radio frequency transmitting element and the receiving of the radio frequency signal from the radio frequency transmitting elements with the identification of the radio frequency transmitting elements, so as to trace a corresponding hydraulic fracture, stimulation, or selective cement job, in the zone of interest.

2. A method as defined in claim 1, wherein said moving includes lowering the reader tool down past the zone of interest, and raising in increments up past the radio frequency transmitting elements in the zone of interest.

3. A method as defined in claim 2, wherein said raising includes raising the reader tool in the increments, and remaining at each increment long enough to generate radio waves by the reader tool over 360° azimuth.

4. A method as defined in claim 1, wherein said analyzing includes sending the data to surface computing means, and analyzing the data by the surface computing means.

5. A method as defined in claim 1, wherein said analyzing includes storing the data in storing means provided in the reader tool, and recovering the data upon returning the reader tool to the surface for analysis of the data on the surface.

6. A method as defined in claim 1; and further comprising supplying power to the reader tool from the surface.

7. A method as defined in claim 1; and further comprising providing a supply of power to the reader tool from a power source integrated in the reader tool.

8. A method as defined in claim 1; and further comprising controlling from the surface a rotation of the reader tool so as to provide a desired orientation of the reader tool.

9. A method as defined in claim 1; and further comprising graphically representing results of the data analysis on a surface by a method selected from the group consisting of printing and plotting.

10. A method as defined in claim 1; and further comprising transmitting a control command to initiate generation of the radio waves by the reader tool.

11. A device for tracing hydraulic fractures, stimulations, or selective cement jobs, in oil and gas wells, comprising a plurality of radio frequency transmitting elements introducable into a well in a zone of interest and each having an identification; a reader tool movable in the well and operative for transmitting radio waves so as to generate and send a radio frequency signal for activating the radio frequency transmitting elements and thereafter to receive a radio frequency signal returned from the corresponding radio frequency transmitting elements together with the identification of each radio frequency transmitting elements; and means for analyzing data related to the sending of the radio frequency signal from the reader tool to the radio frequency transmitting elements and the receiving of the radio frequency signal from the radio frequency transmitting elements with the identification of the radio frequency transmitting elements, so as to trace a corresponding hydraulic fracture, stimulation, or selective cement job, in the zone of interest.

12. A device as defined in claim 11, wherein said moving means is formed so as to lower the reader tool down past the zone of interest, and to raise it in increments up past the radio frequency transmitting elements in the zone of interest.

13. A device as defined in claim 12, wherein said moving means is formed so as to raise the reader tool in increments, remaining at each increment long enough to generate radio waves by the reader tool over 360° azimuth.

14. A device as defined in claim 11, wherein said analyzing means include means for sending the data to surface computing means, and analyzing the data by the surface computing means.

15. A device as defined in claim 11, wherein said analyzing means include means for storing the data in storing means provided in the reader tool, and recovering the data upon returning the reader tool to a surface for analysis of the data on the surface.

16. A device as defined in claim 11; and further comprising means for supplying power to the reader tool from the surface.

17. A device as defined in claim 11; and further comprising means for providing a supply of power to the reader tool from a power source integrated in the reader tool.

18. A device as defined in claim 11; and further comprising means for controlling from a surface a rotation of the reader tool so as to provide a desired orientation of the reader tool.

19. A device as defined in claim 11; and further comprising means for representing results of the data analysis on a surface selected from the group consisting of printing means plotting means, three dimensional imaging means and animation means.

20. A device as defined in claim 11; and further comprising means for transmitting a control command to initiate generation of the radio waves by the reader tool.

* * * * *